US010112215B1

(12) United States Patent
Coots

(10) Patent No.: US 10,112,215 B1
(45) Date of Patent: Oct. 30, 2018

(54) TIE PLATE SEPARATOR AND METHOD THEREOF

(71) Applicant: B&B Metals, Inc., Shepherdsville, KY (US)

(72) Inventor: William R. Coots, Lebanon Junction, KY (US)

(73) Assignee: B&B Metals, Inc., Shepherdsville, KY (US)

( * ) Notice: Subject to any disclaimer, the term of this patent is extended or adjusted under 35 U.S.C. 154(b) by 0 days.

(21) Appl. No.: 15/429,737

(22) Filed: Feb. 10, 2017

Related U.S. Application Data

(60) Provisional application No. 62/296,413, filed on Feb. 17, 2016.

(51) Int. Cl.

| | |
|---|---|
| ***B07B 1/18*** | (2006.01) |
| ***B07B 1/00*** | (2006.01) |
| ***B07B 1/22*** | (2006.01) |
| ***E01B 37/00*** | (2006.01) |

(52) U.S. Cl.
CPC ..... *B07B 1/005* (2013.01); *B07B 1/22* (2013.01); *E01B 37/00* (2013.01)

(58) Field of Classification Search
CPC ..... B07B 1/005; B07B 1/22; E01B 37/00
USPC ..... 209/284, 288, 664, 673, 686, 687
See application file for complete search history.

(56) References Cited

U.S. PATENT DOCUMENTS

| | | | | |
|---|---|---|---|---|
| 847,451 | A | 3/1907 | Wilmore | |
| 1,953,818 | A | 4/1934 | Paridon | |
| 2,341,265 | A | 2/1944 | Crawford | |
| 3,063,543 | A | 11/1962 | Schneider | |
| 3,394,808 | A * | 7/1968 | Thompson | B07B 1/18 209/245 |
| 3,552,539 | A | 1/1971 | Rutter | |
| 3,589,531 | A | 6/1971 | Povlacs | |
| 3,930,595 | A | 1/1976 | Formanski | |
| 4,583,635 | A | 4/1986 | Timmer et al. | |
| 4,896,835 | A * | 1/1990 | Fahrenholz | B07B 1/12 209/234 |
| 5,037,286 | A * | 8/1991 | Roberts | B01J 2/12 106/709 |
| 5,038,914 | A | 8/1991 | Cotic et al. | |
| 5,084,991 | A * | 2/1992 | Cronk, Jr. | E02F 5/226 209/235 |

(Continued)

FOREIGN PATENT DOCUMENTS

| | | |
|---|---|---|
| CA | 2810847 | 9/2013 |
| EP | 0192594 | 7/1989 |

(Continued)

OTHER PUBLICATIONS

Canadian Intellectual Property Office, Office Action for CA Patent App. No. 2,810,688 dated Sep. 28, 2016.
Transmittal Letter of Related Cases, May 17, 2017.

*Primary Examiner* — Terrell H Matthews
(74) *Attorney, Agent, or Firm* — Middleton Reutlinger

(57) ABSTRACT

A tie plate separator is provided and methods thereof which allow for supplying of a batch of scrap material which needs at least some separation. The separation may occur by a rotating receiver structure having a plurality of holes to allow materials of preselected size to be retained within the receiver but allow other materials to fall through the holes so as to effectively separate at least one of the constituents of the batch of materials.

24 Claims, 12 Drawing Sheets

(56) References Cited

U.S. PATENT DOCUMENTS 5,165,520 A 11/1992 Herve et al.
5,210,999 A * 5/1993 Cosimati ..... A01D 45/00 171/129
5,348,162 A * 9/1994 Wroblewski ..... B03B 9/06 198/669
5,607,587 A * 3/1997 Langner ..... B01D 33/067 210/380.3
5,913,402 A 6/1999 Sakota et al.
6,019,227 A * 2/2000 May, III ..... A01K 67/0332 209/284
6,360,894 B1 * 3/2002 Devlin ..... B07B 1/22 209/291
6,564,925 B1 5/2003 Cadwallader et al.
7,497,337 B2 * 3/2009 Tse ..... B02C 17/007 209/284
7,665,599 B2 2/2010 Stibbard
9,016,208 B2 4/2015 Coots
9,038,542 B2 5/2015 Coots
9,328,465 B1 5/2016 Coots
9,422,673 B2 8/2016 Coots
9,457,380 B2 * 10/2016 Davis ..... B07B 1/22
2004/0094188 A1 5/2004 Stalp
2009/0038996 A1 * 2/2009 Sedore ..... B07B 1/12 209/134
2009/0188406 A1 7/2009 Sperling
2009/0218256 A1 * 9/2009 Rasmussen ..... B03B 9/065 209/286
2011/0100248 A1 5/2011 Buckley et al.
2011/0146526 A1 6/2011 Plyer et al.

FOREIGN PATENT DOCUMENTS

EP 0895949 10/1999
EP 0895950 11/2004

* cited by examiner

TIE PLATE SEPARATOR AND METHOD THEREOF

CLAIM TO PRIORITY

This non-provisional patent application claims priority to and benefit of, under 35 U.S.C. § 119(e), U.S. Provisional Patent Application Ser. No. 62/296,413, filed Feb. 17, 2016 and titled "Tie Plate Separator and Method Thereof", all of which is incorporated by reference herein.

STATEMENT REGARDING FEDERALLY SPONSORED RESEARCH

None.

REFERENCE TO SEQUENTIAL LISTING, ETC

None.

BACKGROUND

1. Field of the Invention

Embodiments of apparatuses and methods are taught for separating railroad materials. More specifically, the embodiments pertain to various apparatuses and methods for separating specific railroad track materials such as, for example, tie plates, from other scrap materials which may be collected during a rail replacement or repair project to allow for automated separation of materials and sorting to preselected locations.

2. Description of the Related Art

Current tie plate maintenance systems may pick up tie plates from a railroad tie using magnets during a maintenance procedure. Other systems may be used to sort tie plates in a pile and place them on a distribution system for subsequent installation.

However, other processes require use of multiple employees to manually lift and sort tie plates or otherwise separate the tie plates from scrap material depending upon the function which is occurring in the process. Manual lifting can result in injury which increases the cost of performing the function above and beyond costs for employees. Further, such process may not be performed on site at the repair location, meaning the scrap must be handled to another location for separation.

Accordingly, it would be desirable to provide an apparatus and method which enables the separation of various materials from one another so that the process can occur with fewer injuries and less cost to the railroad operator.

The information included in this Background section of the specification, including any references cited herein and any description or discussion thereof, is included for technical reference purposes only and is not to be regarded subject matter by which the scope of the invention is to be bound.

SUMMARY

A tie plate separator is provided and methods thereof which allow for supplying of a batch of scrap material which needs at least some separation. The separation may occur by a rotating receiver structure having a plurality of holes to allow materials of preselected size to be retained within the receiver but allow other materials to fall through the holes so as to effectively separate at least one of the constituents of the batch of materials.

According to some embodiments, a tie plate separator comprises a rotatable receiver having a first material conveyor at a first location wherein the rotatable receiver receives a mixture of material including some railroad parts from the first material conveyor. The rotatable receiver may have at least one surface and a plurality of holes disposed along the surface. The tie plate receiver may include at least one drive assembly to may rotate the receiver, and at least one pair of rotatable supports which allow rotation of the rotatable receiver. At least one thrust roller limits axial movement of the receiver during rotation. At least one material conveyor may be disposed beneath the rotatable receiver which receives undersized material passing through any of the plurality of holes. At least one second material conveyor may be at a second location of the receiver.

Optionally, the first location of the tie plate separator may be a first end of the rotatable receiver and the second location may be a second end of the rotatable receiver. The first location may be in flow communication with a hopper. The first material conveyor may be a chute or a belt conveyor, roller conveyor or combination. The second material conveyor may be a chute or may be a belt conveyor or roller conveyor or combination. The rotatable receiver may be disposed generally horizontally or may be sloped from a first end to a second end. The tie plate separator may further comprise a vehicle upon which the rotatable receiver is mounted. The at least one pair of rotatable supports may be four rotatable supports. The holes may be sized smaller than at least one dimension of a tie plate, wherein the holes allow passage of undersized scrap material to the at least one conveyor disposed beneath the rotatable receiver. The tie plate separator may further comprise a frame which is movable to adjust a longitudinal angle of the receiver. A jack may be actuated to move the frame. The tie plate separator may further comprising an adjustable support.

According to some embodiments, a rail vehicle which separates mixed rail materials may comprise a vehicle bed, a rotatable receiver positioned on a frame of supports, wherein the receiver may have a first location which receives a mixture of railroad parts. The rotatable receiver may also have at least one surface and a plurality of holes disposed along the surface, at least one drive assembly to rotate the receiver, and at least one pair of rotatable supports. The vehicle may also have at least one thrust roller to limit axial movement of the receiver during rotation. At least one material conveyor may be disposed beneath the rotatable receiver to receive undersized material passing through any of the plurality of holes and, at least one second material conveyor at a second location of the receiver.

Optionally, the rail vehicle may further comprise walls extending about said holes from an outer surface of the receiver. The rail vehicle may further comprise a jack to vary a longitudinal angle of the rotatable receiver.

According to some embodiments, a method of separating railroad materials comprises starting a drive assembly and rotating a receiver, picking a mixed material, including at least some amount of the railroad materials, and placing the mixed material on a feeder at a first location of the receiver, dropping smaller sized portions of the mixed material from the receiver on to a material conveyor, feeding larger portions of the mixed material to a second discharge location of the receiver and onto a discharge conveyor beneath the receiver.

Optionally, the method may further comprise adjusting an angle of the receiver. The method may further comprise varying the speed of material passing through the receiver by adjusting an angle of the receiver.

All of the above outlined features are to be understood as exemplary only and many more features and objectives of a tie plate separator may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the tie plate separator in accordance with the present invention will now be described by way of examples. These embodiments are not to limit the scope of the present claims as other embodiments of the tie plate separator will become apparent to one having ordinary skill in the art upon reading the instant description. Examples of the present embodiments are shown in figures wherein:

DETAILED DESCRIPTION

Figure 1:
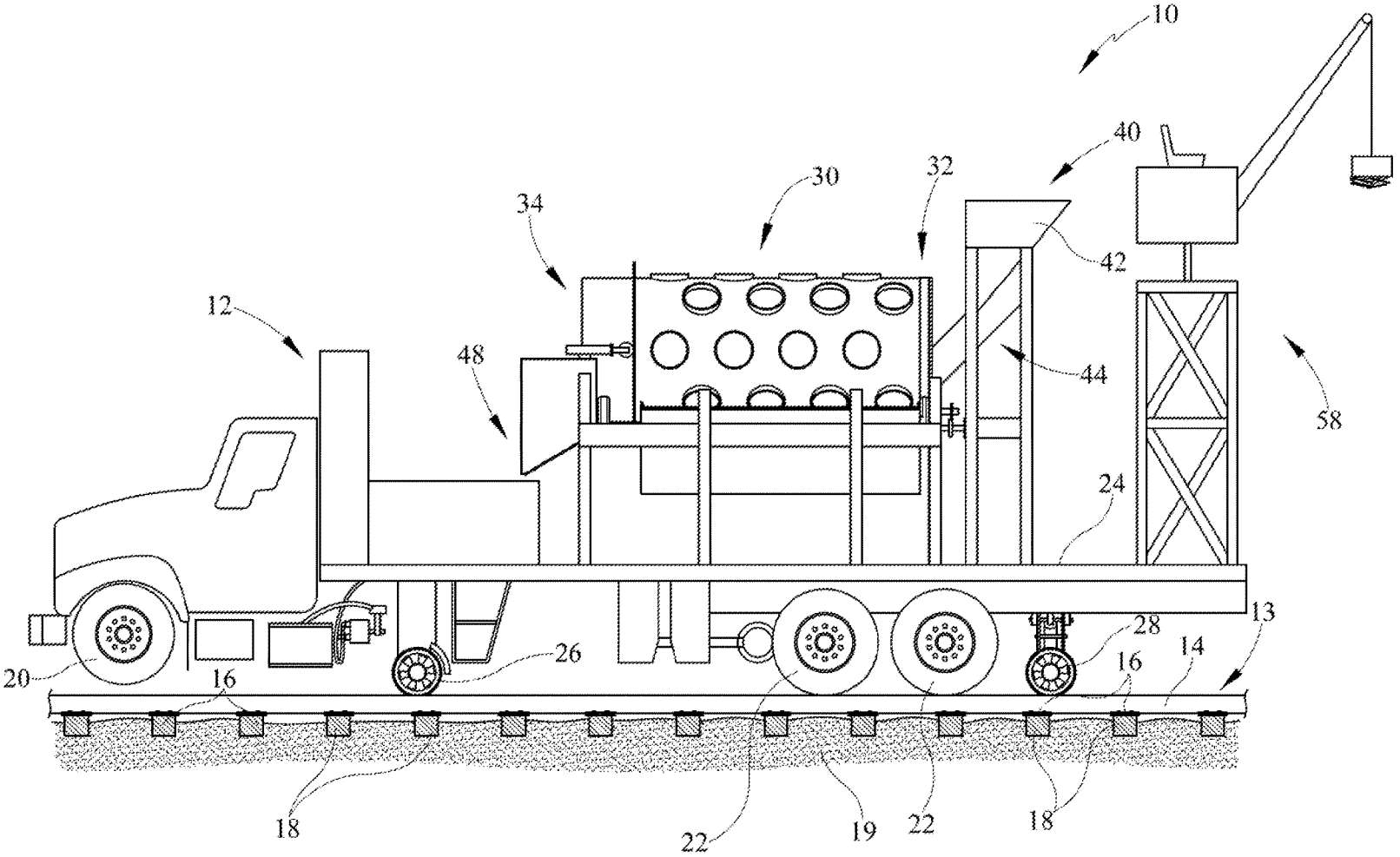
FIG. 1 depicts a side view of one embodiment of a material separator mounted on a high rail vehicle.

It is to be understood that the tie plate separator is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the figures, wherein like numeral indicate like elements throughout several views, there are shown in FIGS. 1 through 12 various aspects of a material separator, for example a tie plate separator which separates a mixture or batches of materials such as railroad scrap material produced during maintenance, repair or refurbishing projects so that at least one desired constituent of the mixture or batch is separated from the remainder of the material. The material separator, for example tie plates, may be mounted on a vehicle which either is driveable or may be pushed or pulled by another driveable vehicle at least along railroad tracks or desirably by a high rail vehicle, which is capable of over-the-road travel as well.

Referring initially to FIG. 1, a tie plate separator 10 is depicted positioned on a vehicle 12. The vehicle 12 may be a high rail vehicle such as the one depicted which allows for over-the-road travel and travel along a rail way. The tie plate separator 10 may be fed material by a crane 58 which in some embodiments, may be mounted on the vehicle 12 or may be mounted to an adjacent vehicle. The crane 58 may be used to provide a material mixture or batch which includes multiple constituents, some of which may be desirable to separate from the remainder of the constituents. The crane 58 may have a claw, bucket or magnet to grab the scrap material and place in the separator 10.

A railroad track 13 may comprise a pair of rails 14 which are positioned on tie plates 16. The tie plates 16 may be fastened to railroad ties 18 which are generally laid perpendicular to the rails 14. In some embodiments, the rails 14 may be transverse but not exactly perpendicular to the railroad ties 18 and therefore, such description should not be considered limiting. The railroad ties 18 are positioned in ballast 19 which may be formed of various substrates, which typically include some amount of gravel or rock.

Referring to the vehicle 12, in some embodiments, the high rail vehicle is desirable for its ability to travel on the road and on a railroad track 13, as shown. The high rail vehicle 12 may have at least one pair of front tires 20 and at least one set of rear tires 22. In the instant embodiment, the high rail vehicle 12 may include two pairs of rear road tires 22 at least one pair which provide propulsion both on the road and for railway travel. In some embodiments, the front tires may also be driven along with the rear tires or independent of the rear tires. In the instant embodiment, the vehicle 12 also includes two pair of rail wheels. In the depicted embodiment, a forward rail wheel 26 is shown which may be height adjustable to engage the track or disengage the track. As shown, the rail wheel 26 is lowered and supporting the vehicle 12 such that the front tire 20 is elevated from the track. This is one embodiment although not a mandatory limiting feature. Further, at the rear end of the vehicle 12 is a second rear wheel 28 which is also engaging the rail 14 to aid in moving the vehicle 12 over the railroad track 13.

The vehicle 12 may also comprise a crane 58 which is mounted at some location on the bed 24 of the vehicle 12 for loading a mixture of materials which will be separated by the separator. The crane 58 may be at a forward or rearward location and should be capable of depositing material in a feeder 40.

The vehicle 12 may also comprise an engine which drives some or all of the tires 20, 22 to drive the vehicle 12. Further, the vehicle 12 may comprise an auxiliary drive system which may drive the rail wheels 26, 28 or drive the road tires 20, 22 or both, in order to move the vehicle 12 along the railroad track 13. The auxiliary drive system may be driven from a power take-off of the engine to power a hydraulic pump or may be powered by a generator and an electric motor or pump.

Figure 2:
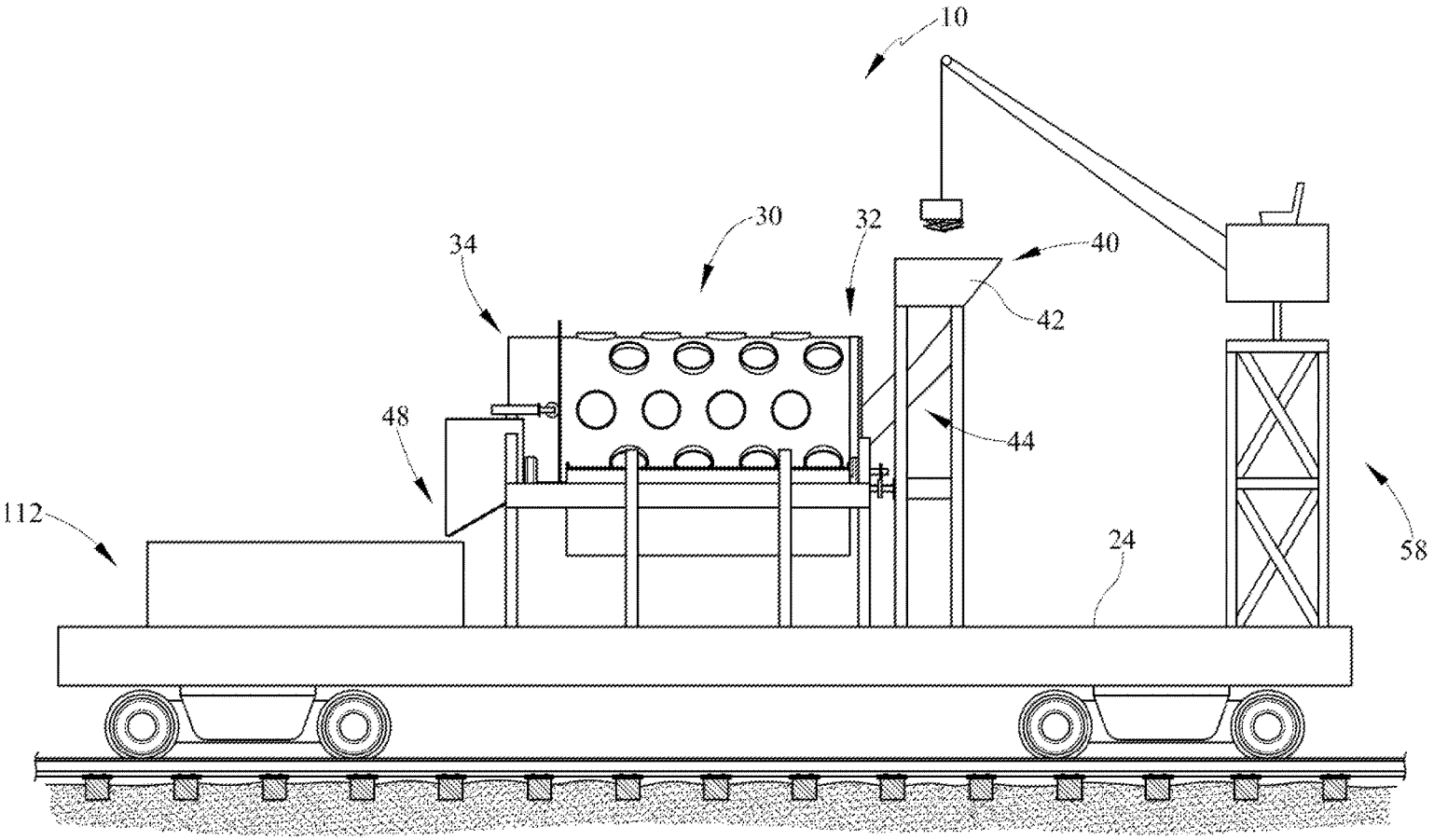
FIG. 2 is a side view of a second embodiment of a vehicle having a material separator.

Referring now to FIG. 2, an alternative vehicle 112 is depicted. The vehicle 112 may be a flat-bed vehicle which is pulled behind a driveable vehicle such as that shown in FIG. 1 or alternatively may be pushed or pulled by way of tow connection. The tie plate separator 10 may be mounted on the flat-bed vehicle 112 which may be embodied by a flat-bed trailer type of arrangement. Thus, various embodiments of vehicles 12, 112 may be considered within the scope of the instant claims. The tie plate separator may be driven hydraulically or electrically, for example by a generator on the vehicle 112 or the vehicle type of FIG. 2. Further, a crane 58 may also be located on the vehicle 112.

Referring still to FIGS. 1 and 2, the tie plate separator 10 includes a receiver 30 which is mounted on the bed 24 of the vehicle 112. The tie plate separator 10 has a feed location 32 which may be at an end of the receiver 30, or may be at some alternate location which is capable of receiving material being fed into the structure and a discharge location 34 which is capable of feeding out from the receiver 30. Likewise, the discharge location may be at an end or may be at some alternate location adjacent to or spaced from an end.

The receiver 30 rotates about a longitudinal axis that is, according to some embodiments, coaxial with the longitudinal axis (front to rear) of the vehicle 12. In alternate embodiments, the receiver 30 may be configured alternatively such that the longitudinal axis of the receiver 30 is at an angle to the longitudinal axis of the vehicle 12. This may depend on whether the vehicle 12 is desired for over-the-road travel in which size limitations may limit the orientation of the receiver to some extent. The receiver 30 has a cylindrical shape in some embodiments, however other rotatable forms may be utilized. For example, a square or other polygon cross-section may be used by having a ring extending about the square or polygon shape.

Toward the first end of the receiver 30 is a material feeder 40. In some embodiments, the feeder 40 is depicted as comprising a hopper 42 which may feed onto one or more conveyors 44. The term "conveyor" as used herein should not be limited a belt or roller type conveyor, but may also include chutes, vibratory feeders and other structures fixed or moving which may move the mixture of materials from a first location to a second location. Thus both moving and fixed structures may be considered conveyors. The instant feeder 40 is formed of a height to utilize gravity to feed the mixture of material toward the feed location 32 of the receiver 30. At an opposite end of the receiver 30 is the discharge chute 48. The discharge chute 48 receives material which passes from the first location 32 to the second location 34.

Figure 3:
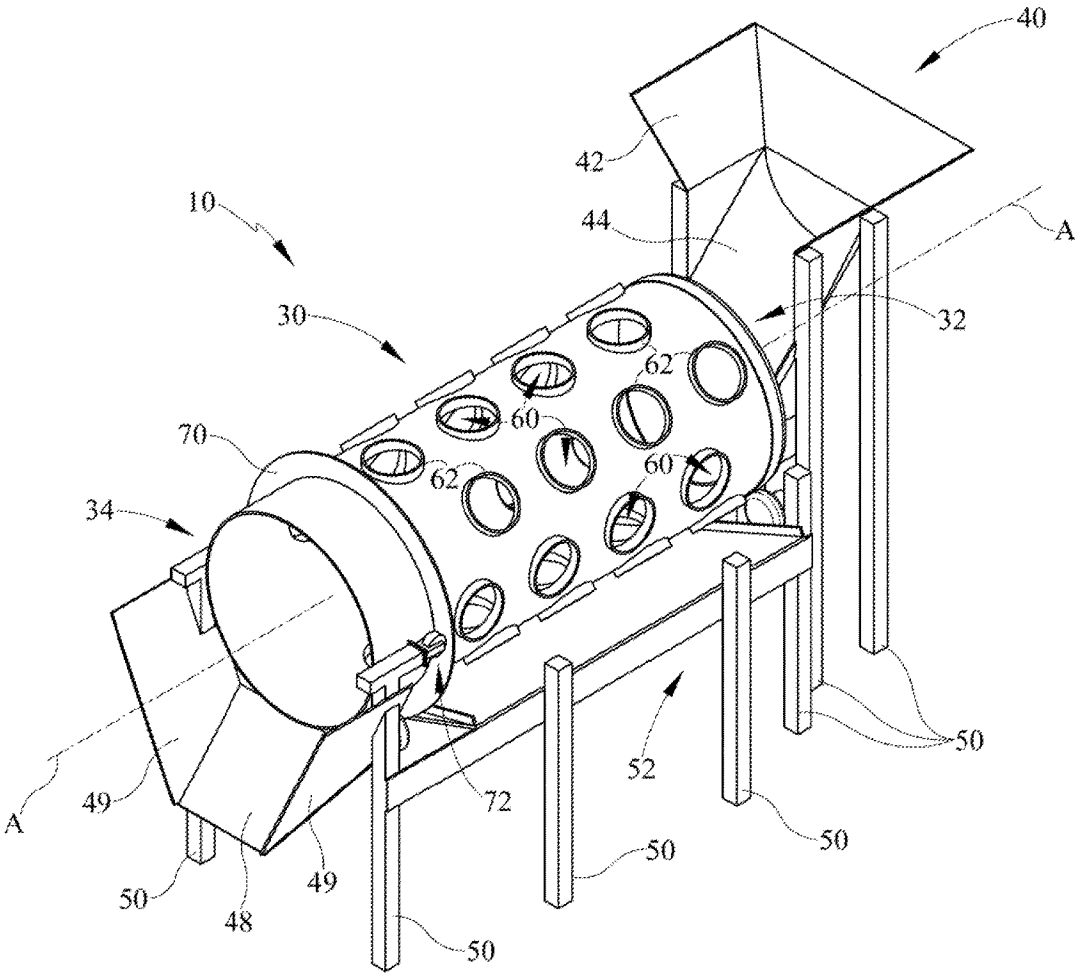
FIG. 3 is an upper perspective view of the material separator removed from the vehicle.

Referring now to FIG. 3, a perspective view of the tie plate separator 10 is depicted. The tie plate separator 10 is mounted on a plurality of support structures 50. The support structures 50 may be formed of structural materials such as beams of various cross-section, box-shaped cross-section structures, for example formed of plate material, or various combinations thereof in order to provide a mounting configuration for positioning the tie plate separator 10 on the vehicle 12. The supports 50 may be of a preselected length to position the receiver 30 at a desired height. The supports 50 define a portion of a frame 52 which supports the receiver 30 on the vehicle bed. The frame 52 may also include horizontal, or substantially horizontal structures. Further, the receiver 30 may be desired to be oriented at an angle relative to horizontal, for example the bed 24 (FIG. 1) of the vehicle 12 so as to encourage materials to move from the first feed location 32 toward the second discharge location 34. In some embodiments, a larger angle relative to the horizontal will increase the speed of the material moving through the receiver 30 while an angle that is closer to the horizontal will slow the material travel through the receiver 30. Further, one or more of the supports 50 may be adjustable in a vertical direction so as to increase or decrease the thru-put speed of the material, for example, a threaded rod assembly which is rotatable to increase or decrease the height that the first feed location 32 may be provided. In alternative embodiments, hydraulic powered jacks may be utilized to increase or decrease the elevation at that location. Thus, such adjustability is desirable to vary the feed rate of material passing through the receiver 30 and may be adjusted when loads vary being fed through the receiver 30. This will described further relative to FIGS. 11 and 12.

At the first feed location 32, the feeder 40 is shown comprising the hopper 42 and feed conveyor 44. The feed conveyor 44 may take various forms but is shown in the form of a chute which feeds material that is dumped into the hopper 42 into the receiver 30. As previously noted, the feed conveyor may be a static or dynamic structure. During this process, the receiver 30 is rotating and receiving the material from the feed conveyor 44. The chute, however, may be formed of alternative structures such as a feed conveyor in the form of a belt or roller conveyor, vibrating conveyor or other structures and/or mechanisms which move material from a first location to a second location. The feed conveyor 44 may be angled so that gravity is utilized to move material from the hopper 42 into the receiver 30. This arrangement reduces the need for moving parts and may be desirable in some instances. Further, the height of the hopper 42 and the height of the receiver 30 may also be factors in the feed conveyor 44. Still further, if an adjustable receiver 30 is used, the movement of the receiver 30 needs to be accommodated.

At the opposite end of the receiver 30, is the discharge chute 48, also a form of a conveyor. The discharge chute 48 may be formed of metal or other rugged material capable of withstanding the movement of material thereacross and may be angled downwardly to utilize gravity at the discharge end of the receiver 30 to remove the tie plates 16 which do not fall through the holes 60 located in the receiver 30. The discharge chute 48 may include sidewalls 49. The discharge chute 48 may move the material to a desired location of the vehicle 12, 112. This may be for storage or for grasping by the crane 58 and off-loading to an alternate location.

Spaced apart along the surface of the receiver 30 are a plurality of holes 60. The holes 60 are sized relative to the material which is desired to be separated. In the instant embodiments, it is desirable to separate tie plates 16 from the remainder of scrap material which is generally found in railroad maintenance jobs. Thus, the holes 60 are sized to have a diameter which is less than at least one of the dimensions of a tie plate 16. In some embodiments, the hole diameter may be sized to be less than two dimensions of the tie plate 16. Further, the holes 60 may be of various sizes. For example, the holes 60 are shown as circular in the embodiments depicted. However, in other embodiments the holes 60 may be square, rectangular or other polygon shapes. Still further, other irregular shapes may be utilized such that at least one of the dimensions of the tie plate 16 is larger than a major dimension of the hole 60, and preferably both width and length of the tie plate 16 are larger than some hole dimension.

Referring still to FIG. 3, the holes 60 are also shown with a wall 62 extending radially outwardly from the receiver surface and about a periphery of each hole 60. The wall 62 has a radial dimension, relative to the receiver 30 which is greater than a distance that certain types of materials may hook or grasp onto. In other words, the dimension of walls 62 inhibit grasping by the rail pins and subsequent blocking of the holes 60 and therefore may depend upon a pertinent dimension of the material, for example rail pins, being sorted.

Further, toward the discharge location 34 is a thrust ring 70. The thrust ring 70 engages rollers which are on the downstream side of the ring 70 and provide a force on the thrust ring 70 in the direction toward the first feed location 32 or end of the receiver 30. As previously described, it may be desirable to provide some angle from the first end to the second end of the receiver 30. By doing so, the receiver 30 has a natural tendency to follow gravity and move toward the discharge end of the supports 50. Thus, the thrust ring 70 being engaged by the thrust rollers 72 preclude such movement of the receiver 30 so that the receiver 30 is maintained in the desired position for rotation. The thrust rollers 72 may be mounted on the frame 52 and according to the depicted embodiments, may be mounted to the supports 50. In the instant embodiment, each roller 72 is positioned on a cross member at or near the top of one of the supports 50 so that the roller 72 engages the thrust ring 70.

Referring still to FIG. 3, the receiver 30 is capable of rotation about the axis A of the receiver 30. During such rotation, the material feeds from the feed location or feed-end 32 to the discharge location or discharge end 34. It should be understood that the use of the term "discharge location" does not necessitate that the feed or discharge location be at the absolute end of the receiver 30. Instead, the feed locations 32, 34 may be near the ends of the receiver 30.

Figure 4:
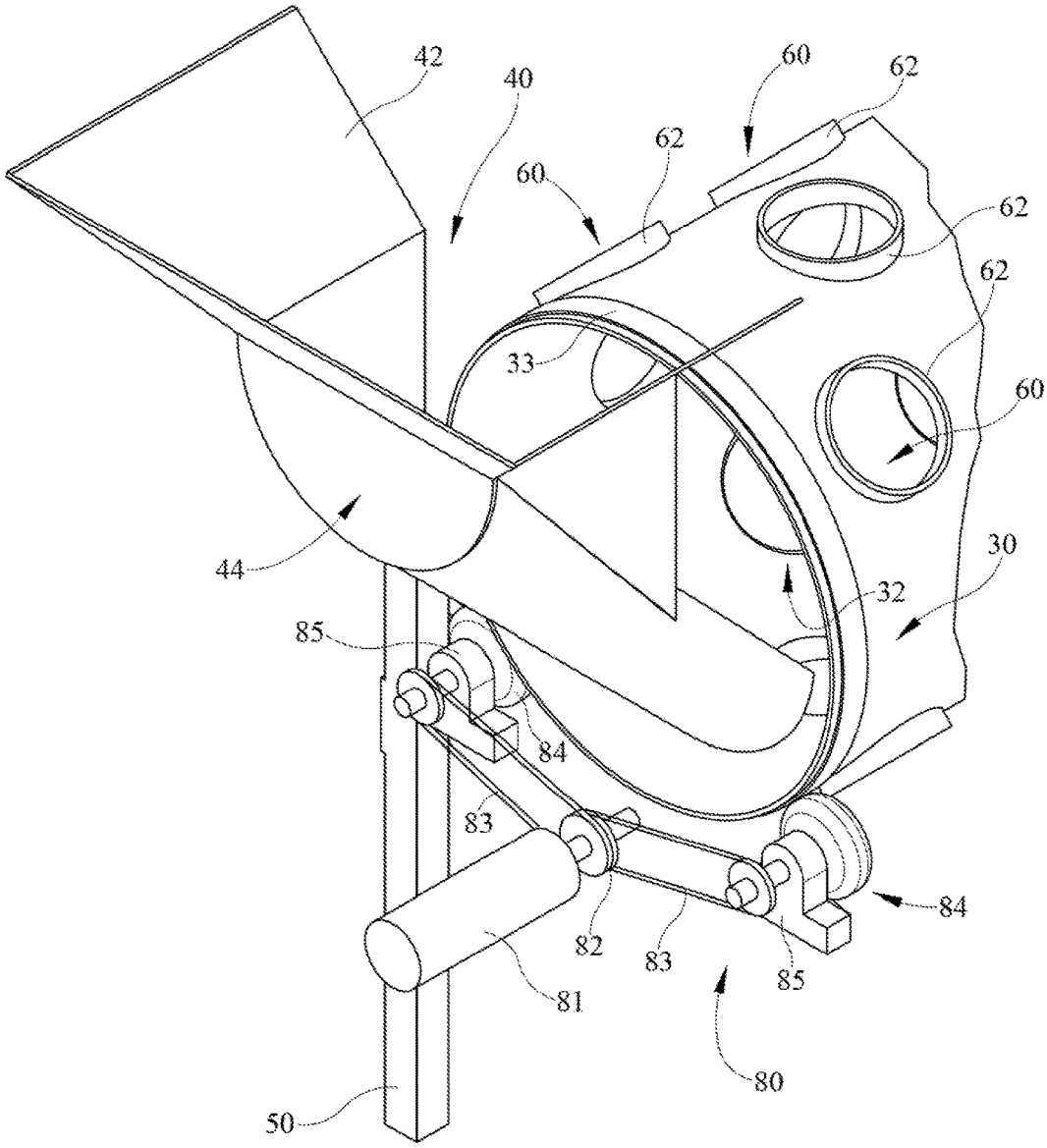
FIG. 4 is a perspective view of the material separator and the drive assembly from a feed-end.

Referring now to FIG. 4, a partial perspective view of the feeder 40 and first feed location 32 are depicted. At the first feed-end of the receiver 30, is a support ring 33 which provides a seat for rollers 84 of a drive assembly 80. The feeder 40 is shown comprising the hopper 42 which is generally defined by angled walls which direct material to drop on to the feed conveyor 44. The feed conveyor 44 directs the material further into the first location or end 32 of the receiver 30.

Beneath the feeder 40, the drive assembly 80 may comprise various forms in structure and operation. In one embodiment, a motor 81 is utilized to drive a pulley or gear 82 which in turn may drive one or more belts or chains 83 and transmit torque to a shaft and support roller 84 by way of a bearing 85. The motor 81 may be electric or may be hydraulic. The power for the motor 81 may come from an electrical system of the vehicle, a generator or a hydraulic pump. Further, the hydraulic pump may be powered by an electric motor or may be operated by a power take-off which drives a fluid pump. In other embodiments, a ring gear may extend about the receiver 30 and may be engaged by a chain. Further a transmission such as a gear box may also be used to drive the receiver rotation. Such gear box may also, for example, be used in combination with a chain or belt drive. In some embodiments, the rollers 84 may include a shaft which extends to the opposite end of the receiver 30 so as to engage support rollers at the opposite end of the receiver 30 and cause rotation of those rollers. However, in the depicted embodiment, a single drive assembly 80 is utilized to drive one end and the opposite end of the receiver 30 may be rotatably supported and rotate freely independent of the rollers 84 at the first feed location 32. Still further, while the rollers 84 are shown at the end of the receiver 30, they may be moved to various locations along the longitudinal length of the receiver 30, as long as the receiver 30 is supported and will rotate without becoming unbalanced. Further, the roller 84 may be formed of metal or may be formed of tires which aid in causing rotation of the receiver 30 and may provide improved grip relative to the receiver 30. Still further, the ring 33 may be formed of solid metal plate material or may have expanded metal or other materials to improve gripping between the rollers 84 and the receiver. Still further, while the ring 33 is shown at one end of the receiver 30, the opposite end of the receiver 30 may include a ring or a ring may be defined by the metal or other structure of the receiver at that end.

This view also shows that the walls 62 which extend from the holes 60 have a height dimension which extends outwardly from the outer surface of the receiver 30. This dimension is larger than a dimension of pin hooks so as to prevent the pins from otherwise grabbing the edges of the holes and blocking the holes 60.

Figure 5:
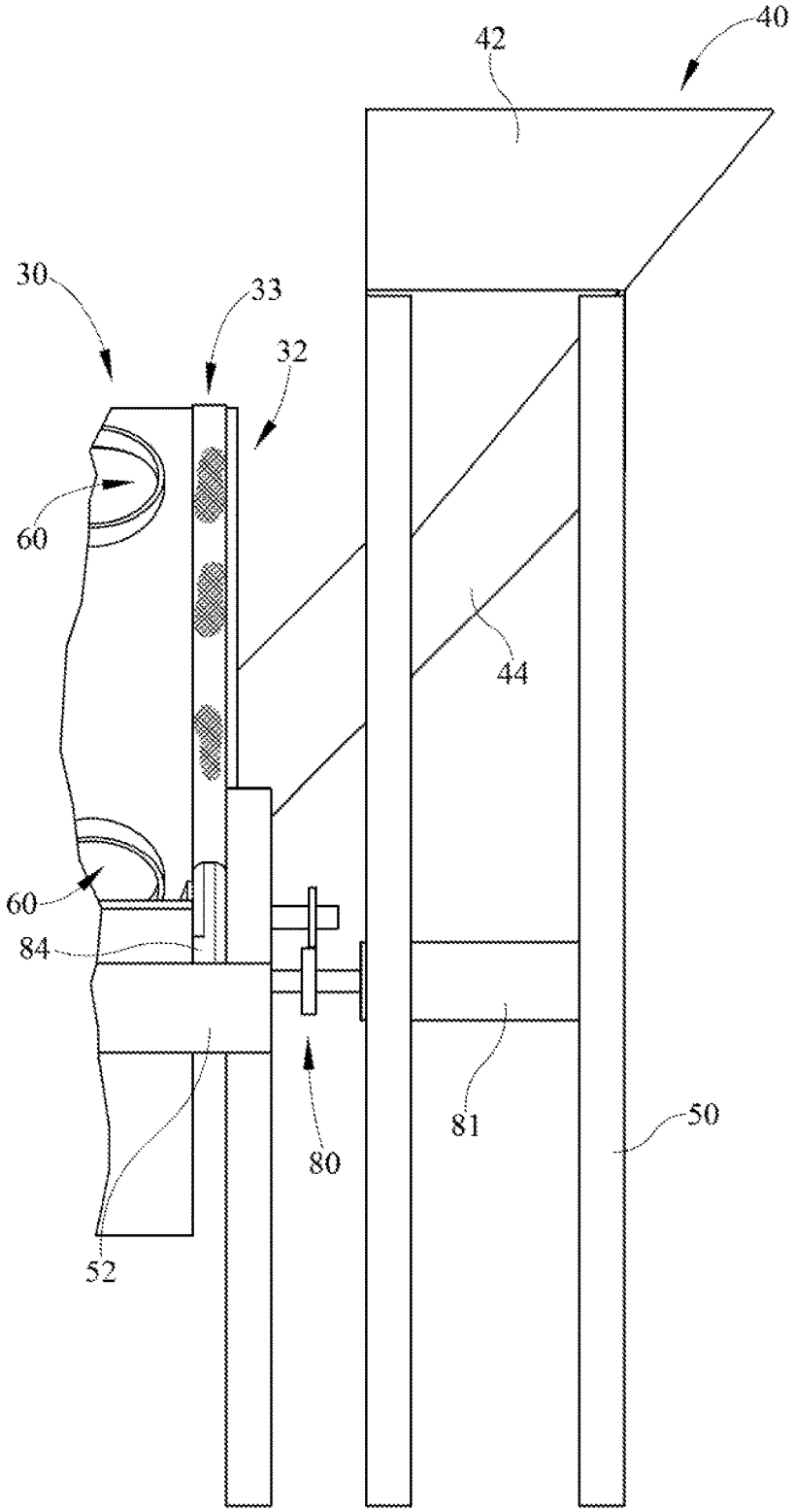
FIG. 5 is a side view of a feed-end of the separator and including the drive assembly.

Referring now to FIG. 5, a side view of the feed location 32 of the receiver 30 is depicted. At this feed-end 32, the feeder 40 directs material into the receiver 30 and deposits the material within the receiver 30. The support ring 33 is shown in this embodiment formed of a graded or expanded metal so as to improve engagement with the roller 84. The roller 84 is driven by the motor 81 as part of the drive assembly 80. During rotation, the receiver 30 receives a mixture of railway scrap material passing from the feeder 40 into the receiver 30. The undersized material will exit through the apertures 60 while the oversized material, which may include for example, tie plates 16 that need to be sorted, will continue traveling through the receiver 30 to the discharge location 34 (FIG. 3).

Figure 6:
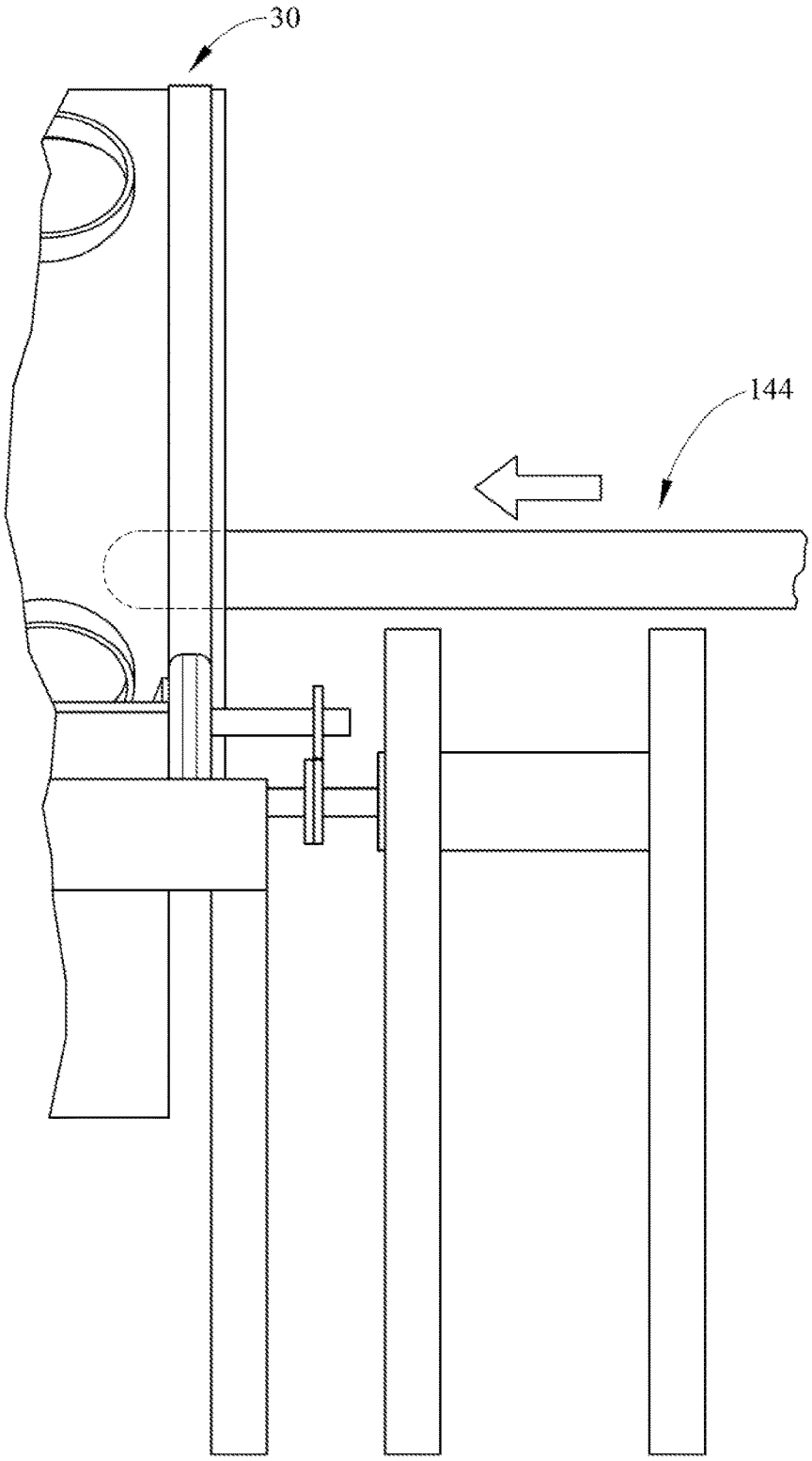
FIG. 6 is an alternative embodiment with an alternate conveyor such as a roller conveyor feeding a feed location of the separator.

Referring to FIG. 6, an alternate embodiment is shown in side schematic view wherein the feed conveyor 44 (FIG. 5) is of an alternate structure. In the instant embodiment, a schematic view of a belt conveyor 144 is depicted as being the feed conveyor structure for the receiver 30. Utilizing such structure, the material will feed along the belt 144 into the receiver 30. Further, the belt conveyor 144 is depicted as generally horizontal but may also be angled to be gravity fed if desirable.

Figure 7:
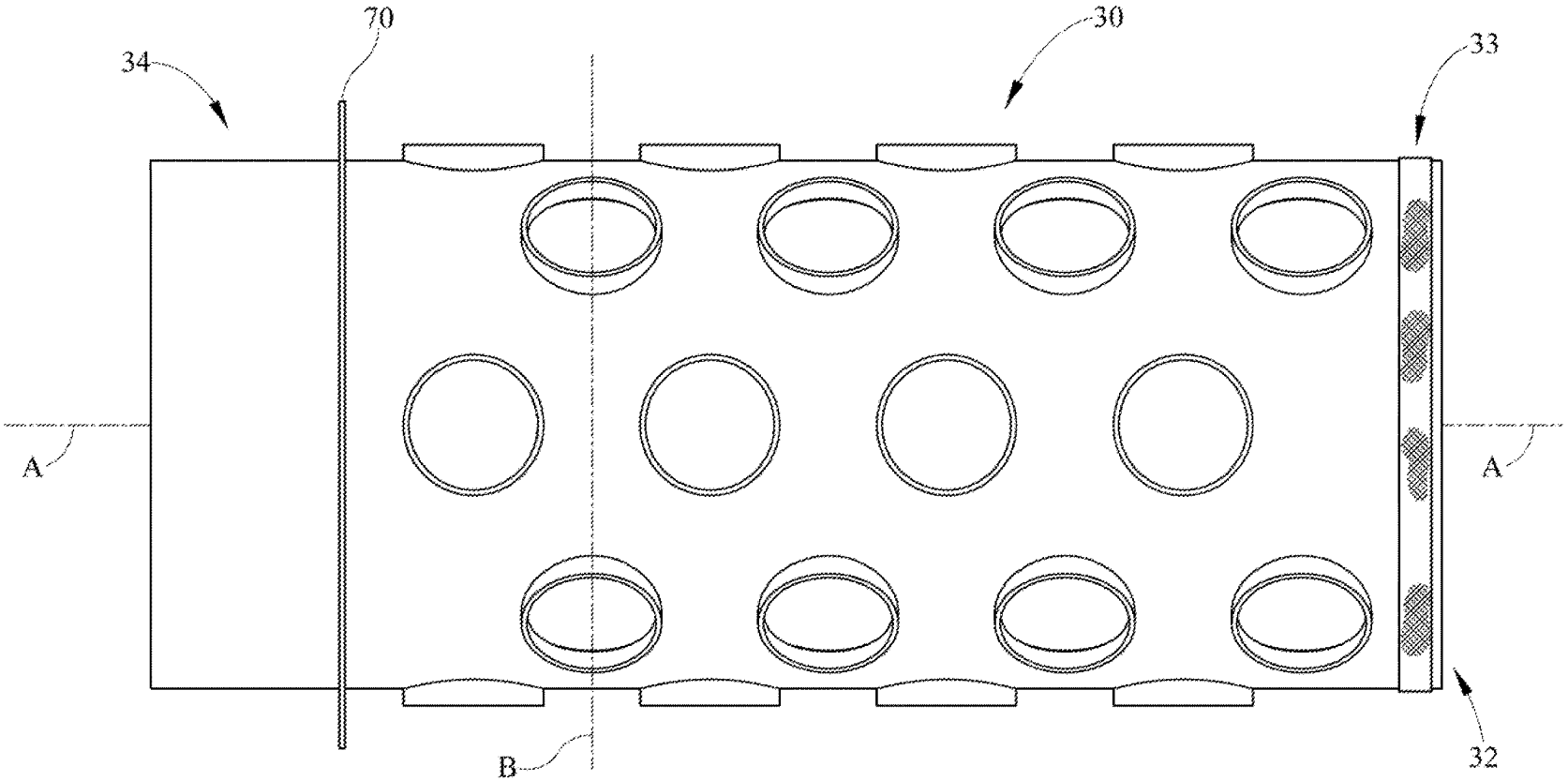
FIG. 7 is a top view of the separator.

Referring to FIG. 7, a top view of the receiver 30 is shown. The holes 60 are spaced apart in some preselected fashion. A longitudinal axis A is shown and a line B which is transverse to axis A. The spacing of the holes 60 is shown in an off-set fashion. Thus, when viewed in a direction B transverse to the longitudinal axis A of the receiver 30, the holes 60 in each adjacent row are off-set from one another longitudinally. The holes 60 may be spaced from one another apart in a first direction, a second direction or both. Further, the holes 60 may be irregularly spaced rather than in any preselected pattern. Additionally, the thrust ring 70 is shown toward the discharge end 34 of the receiver 30. The thrust ring 70 is engaged to preclude movement of the receiver 30 in a longitudinal direction.

The thrust ring 70 is inset from the discharge end 34 some distance and allows for a chute or other discharge conveyor to be located at least partially beneath the discharge end 34 so that material cannot fall away from the receiver 30 into an unintended location.

Figure 8:
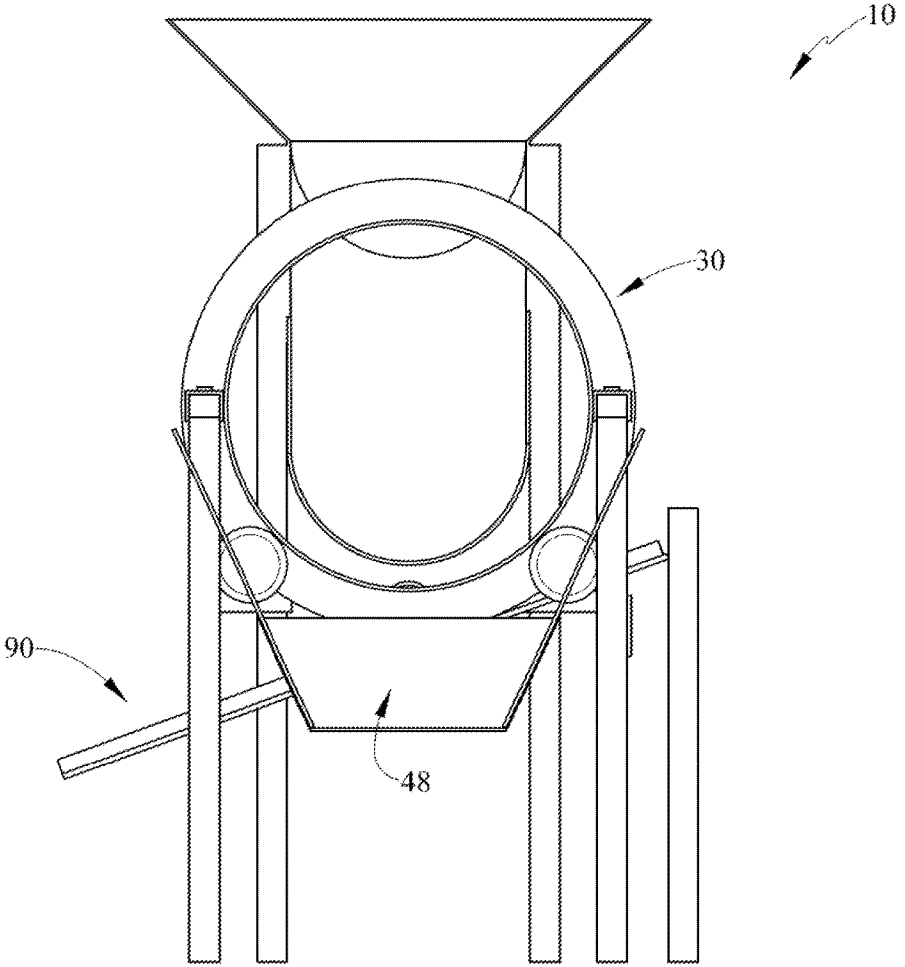
FIG. 8 is an end view of a discharge end of the separator and further shows the discharge location extending beneath the separator before the discharge location.

Referring now to FIG. 8, an end view of the tie plate separator 10 is shown. Beneath the receiver 30 is an undersized material conveyor 90. The conveyor 90 receives undersized material that falls through the holes 60 of the receiver 30. In the exemplary embodiment, the undersized material might be scrap metal, pins, nails, other materials that fit through the holes 60 and are less than the size of a tie plate 16 which will not fit through the holes 60. Such tie plates 16 extend through the receiver 30 and discharge at the discharge chute 48. The tie plates 16 are deposited at a desired location.

Figure 9:
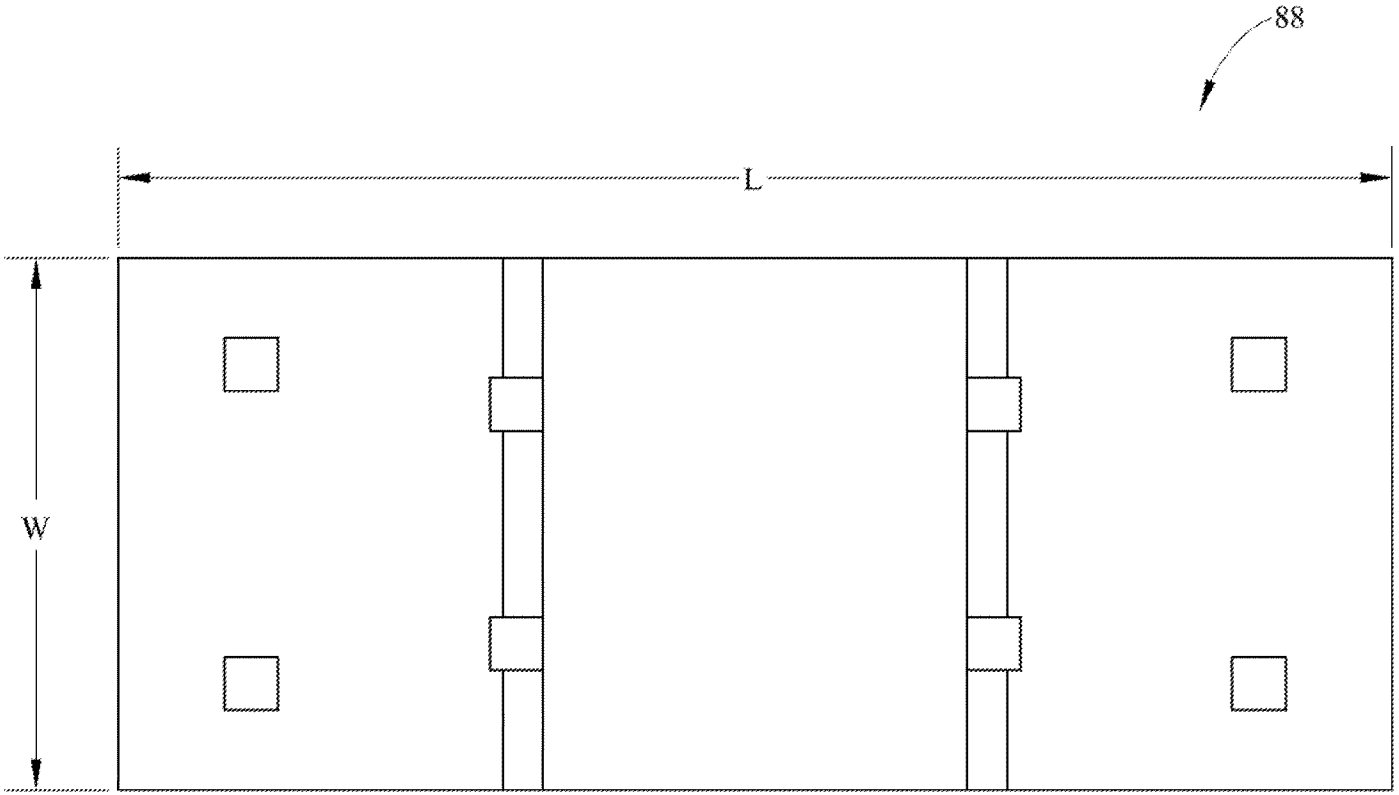
FIG. 9 is a top view of an exemplary tie plate.
Figure 10:
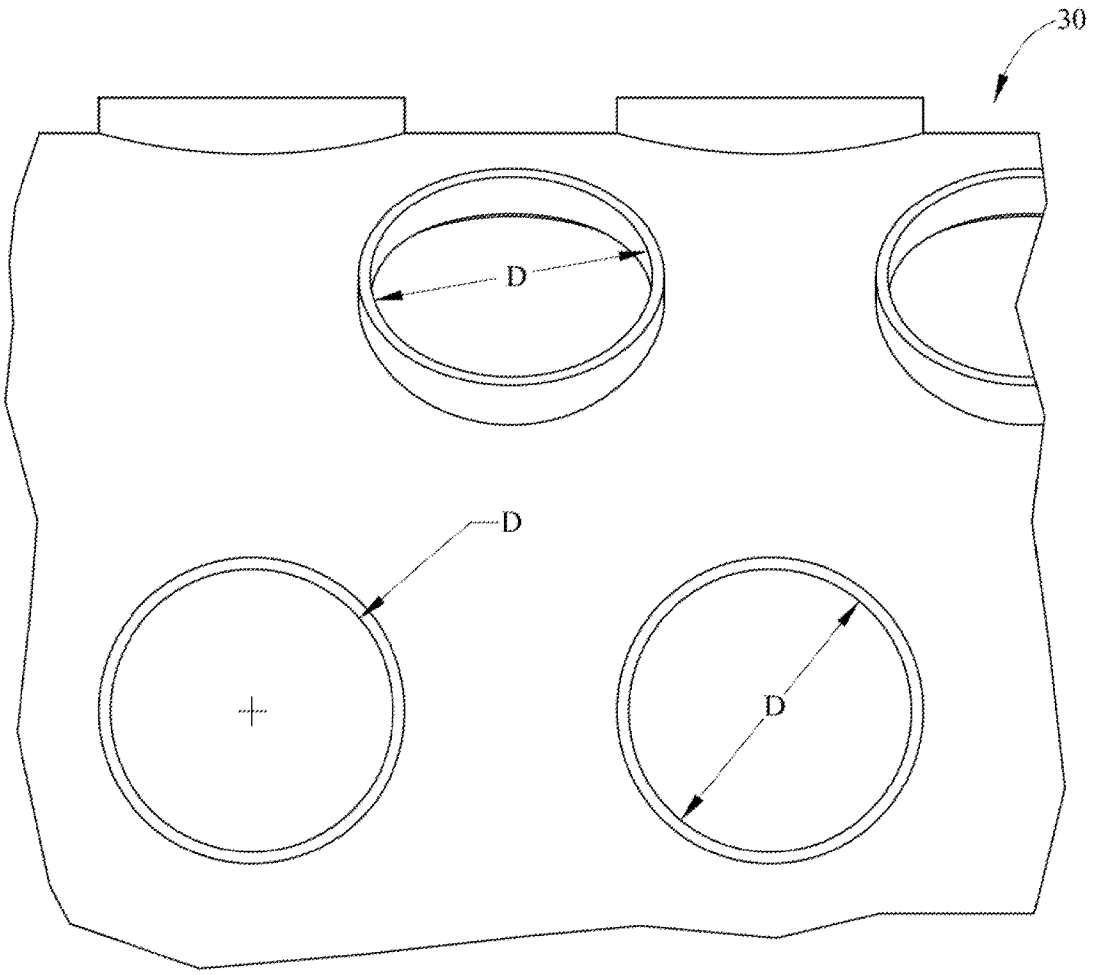
FIG. 10 is a detailed perspective view of several apertures of the separator.

With reference to FIGS. 9 and 10, the dimensional relationship of the holes 60 is shown. Each hole 60 has a diameter dimension D. Each of the diameters is sized to be less than at least one dimension of the sorted tie plate 88. Each tie plate 88 has a width dimension W and a length dimension L. In the exemplary embodiment, both of the width and length W, L are greater than the diameter dimension D. Thus, the tie plates 88 continue passing through the receiver 30 during its rotation and the undersized scrap material will fall through the holes 60 for discharge to a different location than the sorted tie plates 88. The diameters are shown as being the same size but may alternatively, be of varying sizes so long as the diameter is smaller than at least one dimension of the tie plates to be sorted.

In operation, the drive assembly 80 is started and as described may be powered from the electrical system of the vehicle, from a generator, or may be driven power a power take off of the vehicle engine or a combustion or diesel engine mounted thereon. As the drive assembly 80 is driven and the motor 81 causes rotation of the receiver 30, mixed materials may be loaded into the feeder 40. The mixed materials may be located along the railside or may be located on a vehicle or gondola after being collected at a rail.

As the rotation occurs, the mixed material is picked by a crane 58 and moved into a first feed location 32, for example at one end of the receiver 30. The picking may occur by bucket, magnet, claw or other grasping structure. Further, the rotation and slight angle of the receiver 30 may cause the mixed material to move axially through the receiver 30. As the material reaches holes 60 in the receiver, the mixed materials may be separated by the holes 60. The holes are sized to be smaller than a size of a material desired to be separated from the remainder of materials. Thus, the smaller materials can fall from the receiver 30 through holes 60 to the material conveyor 90. Additionally, the larger materials, such as tie plates are retained in the receiver 30 and travel to the discharge location 34 for further travel along material conveyor 90.

Figure 11:
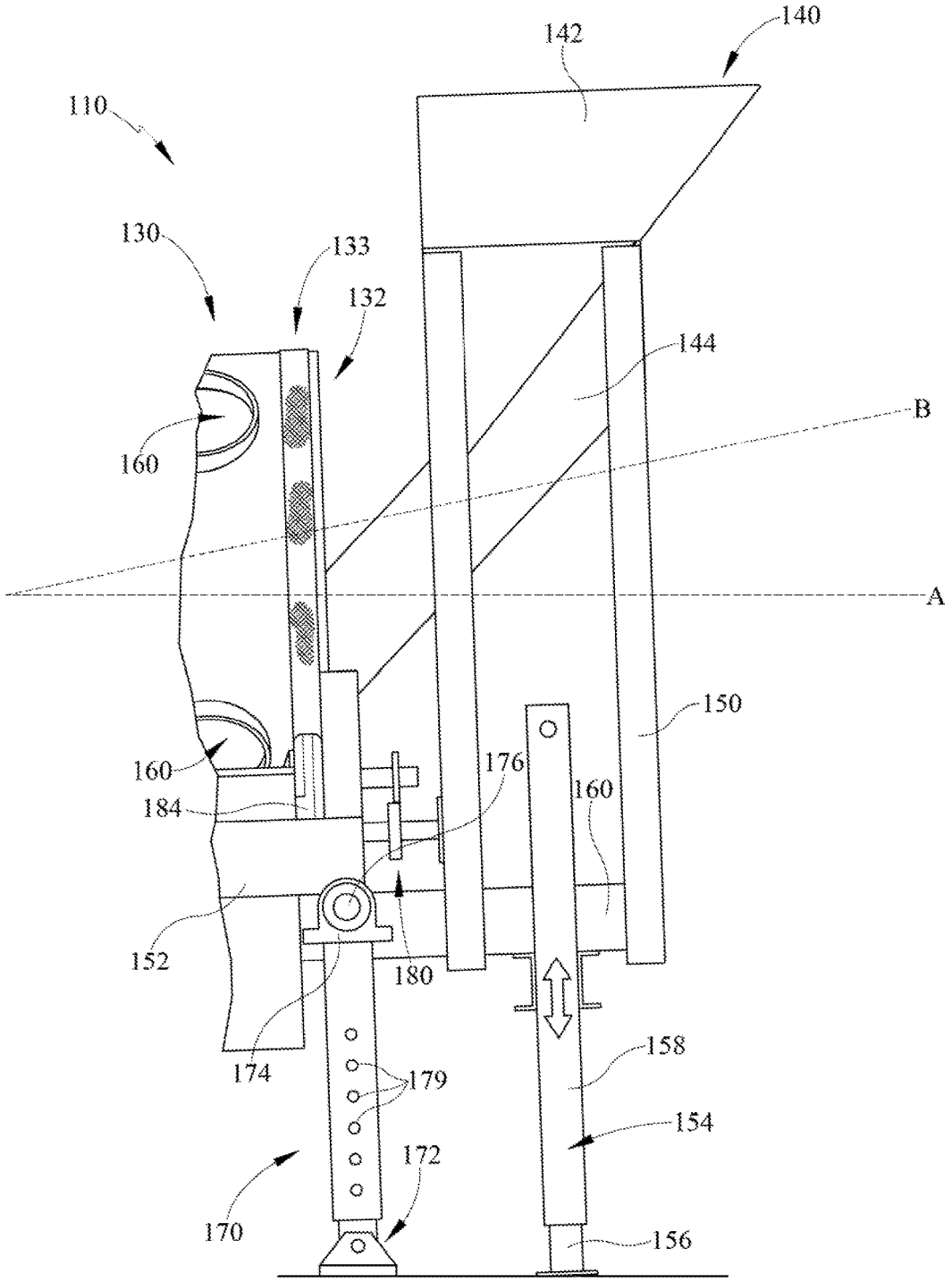
FIG. 11 is a side view of the mixed material separator which has at least one adjustable end feature; and, FIG. 12 is a side view of an alternative embodiment having height adjustable separator.

Referring now to FIG. 11, a side view of an alternate embodiment is shown wherein a jack is used to vary the height of the separator 110 and therefore vary the speed of material passing through the separator 110. The present embodiment includes a jack 154 including a male portion 156 and a female portion 158. In some embodiments, the jack 154 may be driven by rotary motion to provide linear movement, such as by a threaded rod arrangement either internal or external to the jack 154. In other embodiments, the jack 154 may be moved linearly by a hydraulic assembly which may be positioned internally or externally to the jack 154. Other moving features may be provided which operate either by manual input or automated input, such as by electric or hydraulic operation, or still other embodiments may be utilized.

The jack 154 is moveable between a first upper position and a second lower position, as indicated by the double headed arrow. The jack 154 may be seated on the bed of the vehicle 12, 112 or may be connected to structural members of the vehicles. From the seated position, the female portion 158 may move up and down. This may be reversed however in alternate embodiments. A cross beam 160 is operably engaged to the jack 154, specifically the female portion 158. The cross beam 160 may move vertically with the jack 154. The cross beam 160 may define a portion of the frame 152, such as by extending therefrom.

Moving to the left of the figure, the opposite end of the cross beam 160 is engaging the frame 152 and may provide support therefore. The vertical movement of cross beam 160 will lift or lower the frame 152 and cause corresponding lifting or lowering of an end, such as for example the feed location 132, at the receiver 130. The lifting or lower of an end of the receiver 130 changes the longitudinal axis of the receiver 130. By changing the angle of the receiver 130, the speed of the materials passing through the receiver 130 may be varied without changing the speed of the motor or drive assembly 180.

As shown in the Figure, two broken lines A, B are shown representing axes of the receiver 130. Axis A is shown representing a lower position of the jack 154 wherein the axis A is closer to horizontal. Axis B represents a second portion and the angle of axis B is exaggerated for purpose of ease of visualization. To position the receiver axis in the position B, the jack 154 is raised. As a result, the feed rate of material through the receiver may be increased. This adjustability may be used to vary feed speed for example when larger loads of material need separation and rate of passage through the receiver need to be faster. Alternatively, this may help with a fixed speed motor, which may be used instead of a variable speed motor.

Beneath the frame 152 and adjacent to the jack 154 is an adjustable support 170. The support 170 provides support for the separator 110 once the receiver is moved to a desired angle. In the depicted embodiment, the adjustable support 170 includes a pivot joint 172 at one end, for example the lower end and at an upper end includes a bearing 174 to retain a shaft 176. The shaft 176 may extend to engage the frame 152. The lower joint 172 allows for angular variation of the support 170 with movement of the receiver 130. Further, once the height of the receiver 130 is obtained with the jack 154, or alternatively once the desired rate of material is achieved through the receiver 130, the support 170 may include a plurality of pin stops 179. The pin stops 179 provide for insertion location of pins which remove the load from the jacks 154 and allow for support of the receiver 130 at the desired angle by the adjustable support 170.

Figure 12:
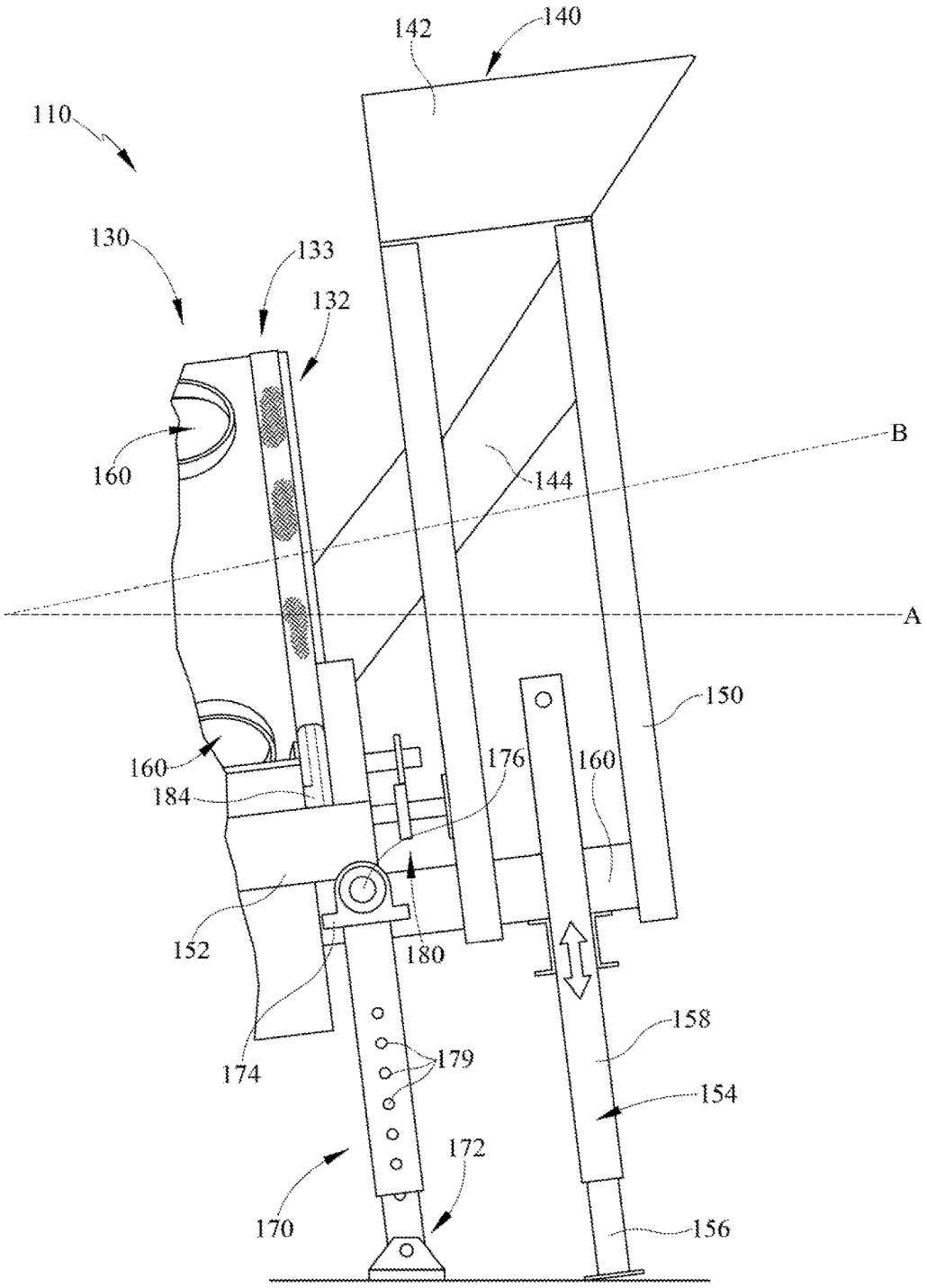

Referring now to FIG. 12, a side view of the receiver 130 is depicted. The jack 154 is extended relative to the view of FIG. 11. In this extended position, the receiver 130 is moved to the position shown corresponding to axis B of FIGS. 11 and 12. Further, the support 170 is shown pivoted at joint 172 to accommodate the position change of the receiver 130. Once positioned at a desired height, pins may be positioned through stops 179.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A tie plate separator, comprising:

a rotatable receiver having a first material conveyor at a first feed location wherein said rotatable receiver receives a mixture of material including some railroad parts from said first material conveyor;

said rotatable receiver having at least one interior circumferential surface which supports said mixture of material and a plurality of holes disposed through said surface;

each of said plurality of holes having a wall which surrounds said hole and extends from an exterior side of said hole;

at least one drive assembly to rotate said receiver, and at least one pair of rotatable supports which allow rotation of said rotatable receiver;

at least one thrust roller to limit axial movement of said receiver during rotation;

at least one material conveyor disposed beneath said rotatable receiver to receive undersized material passing through any of said plurality of holes; and, at least one second material conveyor at a second discharge location of said rotatable receiver.

2. The tie plate separator of claim 1, said first location being a first end of said rotatable receiver.

3. The tie plate separator of claim 1, said second location being a second end of said rotatable receiver.

4. The tie plate separator of claim 1, said first location being in flow communication with a hopper.

5. The tie plate separator of claim 1, said first material conveyor being a chute.

6. The tie plate separator of claim 1, said first material conveyor being a belt conveyor.

7. The tie plate separator of claim 1, said second material conveyor being a chute.

8. The tie plate separator of claim 1, said second material conveyor being a belt conveyor.

9. The tie plate separator of claim 1, said rotatable receiver disposed generally horizontally.

10. The tie plate separator of claim 1, said rotatable receiver being sloped from a first end to a second end.

11. The tie plate separator of claim 1 further comprising a vehicle upon which said rotatable receiver is mounted.

12. The tie plate separator of claim 1 wherein said at least one pair of rotatable supports is four rotatable supports.

13. The tie plate separator of claim 1 wherein said holes are sized smaller than at least one dimension of a tie plate.

14. The tie plate separator of claim 1 wherein said holes allow passage of undersized scrap material to said at least one conveyor disposed beneath said rotatable receiver.

15. The tie plate separator of claim 1 further comprising a frame which is movable to adjust a longitudinal angle of the receiver.

16. The tie plate separator of claim 15 further comprising a jack which may be actuated to move said frame.

17. The tie plate separator of claim 16 further comprising an adjustable support.

18. A rail vehicle which separates mixed rail materials, comprising:

a vehicle bed;

a rotatable receiver positioned on a frame of supports, said receiver having a first feed location which receives a mixture of railroad parts;

said rotatable receiver having at least one circumferential inner surface which supports said mixture of railroad parts within said rotatable receiver and a plurality of holes disposed through said surface;

a wall extending from an exterior of said rotatable receiver and about each of said plurality of holes;

at least one drive assembly to rotate said receiver, and at least one pair of rotatable supports;

at least one thrust roller to limit axial movement of said receiver during rotation;

at least one material conveyor disposed beneath said rotatable receiver to receive undersized material passing through any of said plurality of holes; and, at least one second material conveyor at a second discharge location of said receiver.

19. The rail vehicle of claim 18 further comprising walls extending about said holes from an outer surface of said receiver.

20. The rail vehicle of claim 18 further comprising a jack to vary a longitudinal angle of said rotatable receiver.

21. A method of separating railroad materials, comprising:

starting a drive assembly and rotating a receiver;

picking a mixed material including at least some amount of said railroad materials and placing said mixed material on a feeder at a first location of said receiver;

dropping smaller sized portions of said mixed material from said receiver on to a material conveyor beneath said receiver, said dropping being through holes having surrounding walls; and, feeding larger portions of said mixed material to a second discharge location of said receiver and onto a discharge conveyor.

22. The method of claim 21 further comprising adjusting an angle of said receiver.

23. The method of claim 21 further comprising varying the speed of material passing through the receiver by adjusting an angle of said receiver.

24. The method of claim 21 further comprising positioning of a vehicle having said receiver in a desired location for material separation.

* * * * *